US005333692A

United States Patent [19]

Baugh et al.

[11] Patent Number: 5,333,692

[45] Date of Patent: Aug. 2, 1994

[54] STRAIGHT BORE METAL-TO-METAL WELLBORE SEAL APPARATUS AND METHOD OF SEALING IN A WELLBORE

[75] Inventors: John L. Baugh, Houston; George J. Melenyzer, Humble, both of Tex.

[73] Assignee: Baker Hughes Incorporated, Houston, Tex.

[21] Appl. No.: 827,411

[22] Filed: Jan. 29, 1992

[51] Int. Cl.[5] ..... E21B 33/128

[52] U.S. Cl. ..... 166/387; 166/182; 166/191; 166/208; 277/117; 277/236

[58] Field of Search ..... 166/208, 88, 217, 191, 166/115, 192, 387, 196; 277/117, 118, 116.6, 116.8, 206 R, 208, 236; 285/140, 146, 351, 341, 348

[56] References Cited

U.S. PATENT DOCUMENTS

| | | | |
|---|---|---|---|
| 4,588,029 | 5/1986 | Blizzard | 277/236 X |
| 4,719,971 | 1/1988 | Owens | 166/191 |
| 4,749,035 | 6/1988 | Cassity | 166/217 X |
| 4,751,965 | 6/1988 | Cassity | 166/182 |
| 4,787,642 | 11/1988 | Etheridge | 277/236 X |
| 4,790,572 | 12/1988 | Slyker | 166/208 X |
| 4,791,987 | 12/1988 | Cassity et al. | 166/208 |
| 4,823,871 | 4/1989 | McEver et al. | 166/182 |
| 4,842,061 | 6/1989 | Nobilean | 166/208 X |
| 5,038,865 | 8/1991 | Taylor et al. | 166/208 X |
| 5,076,356 | 12/1991 | Reimert | 166/115 |
| 5,095,991 | 3/1992 | Milberger | 166/380 |
| 5,114,158 | 5/1992 | Le | 277/117 X |
| 5,174,376 | 12/1992 | Singeetham | 166/208 |

*Primary Examiner*—Hoang C. Dang
*Attorney, Agent, or Firm*—Melvin A. Hunn

[57] ABSTRACT

A seal apparatus is provided for use in a subterranean wellbore having a wellbore tubular disposed therein. The wellbore tubular defines a wellbore surface. The seal includes a number of components which cooperate together. A conveyance tubular is provided, which is positionable within the subterranean wellbore at a selected location relative to the wellbore surface. A sealing ring is provided, and disposed about at least a portion of the conveyance tubular. The sealing ring has a first surface proximate the conveyance tubular and a second surface which is removed in distance from the conveyance tubular. The second surface defines a sealing surface, and includes a plurality of portions, with selected ones of the plurality of portions of the sealing ring extending radially from the conveyance tubular in at least one radial dimension. The selected portions define at least one metal seal point for selectively and sealingly engaging the wellbore surface. The seal apparatus is operable in a plurality of modes, including a running mode of operation and a sealing mode of operation.

22 Claims, 8 Drawing Sheets

STRAIGHT BORE METAL-TO-METAL WELLBORE SEAL APPARATUS AND METHOD OF SEALING IN A WELLBORE

BACKGROUND OF THE INVENTION

1. Field of the Invention

The present invention relates generally to metal-to-metal seals for use in oil and gas wellbores, and specifically to metal-to-metal seals which are run into the wellbore and set against wellbore surfaces.

2. Description of the Prior Art

Wellbore completion operations frequently require the make-up of a high quality, gas-tight seals, which are intended for long service lives. Seals which include elastomeric components are subject to eventual deterioration after prolonged exposure to corrosive fluids and high temperatures. Also, when energized, elastomeric components are likely to flow along extrusion pathways if unchecked.

Furthermore, as prior art seal device are lowered into oil and gas wellbores, elastomeric components are exposed to axial forces from fluids in the well, which sometimes cause the removal, or "swabbing-off", of the elastomeric component, severely impairing the operation of the seal.

Metal components can be used to obtain gas tight seals, but are generally suited for rather pristine environments other than wellbores. One problem with metal sealing components is that, like elastomeric components, metal sealing components will eventually become degraded after prolonged exposure to corrosive fluids.

SUMMARY OF THE INVENTION

It is one objective of the present invention to provide a metal-to-metal seal for use in sealing against a straight bore tubular member disposed in a wellbore.

It is another objective of the present invention to provide a wellbore seal which combines the advantages of elastomeric and metal-to-metal seals.

It is still another objective of the present invention to provide a wellbore seal which includes both metal-to-metal and elastomeric sealing members which operate in combination to provide a high quality, gas-tight seal in a wellbore.

It is yet another objective of the present invention to provide a seal apparatus for use in a wellbore having a sealing surface which includes a plurality of extender portions which define metal seal points which engage a wellbore surface during a sealing mode of operation.

It is still yet another objective of the present invention to provide a seal apparatus for use in a wellbore having a sealing surface which includes a plurality of extender portions which define metal seal points which engage a wellbore surface during a sealing mode of operation, said seal apparatus further including a layer of resilient material disposed over the sealing surface, wherein the extender portions provide a skeletal structure for the layer of resilient material to prevent swabbing-off of the layer of resilient material during a running mode of operation.

These and other objectives are achieved as is now described. A seal apparatus is provided for use in a subterranean wellbore having a wellbore tubular disposed therein. The wellbore tubular defines a wellbore surface. The seal includes a number of components which cooperate together. A conveyance tubular is provided, which is positionable within the subterranean wellbore at a selected location relative to the wellbore surface. A sealing ring is provided, and disposed about at least a portion of the conveyance tubular. The sealing ring has a first surface proximate the conveyance tubular and a second surface which is removed in distance from the conveyance tubular. The second surface defines a sealing surface, and it includes a plurality of portions, with selected ones of the plurality of portions of the sealing ring extending radially from the conveyance tubular in at least one radial dimension. The selected portions define at least one metal seal point for selectively and sealingly engaging the wellbore surface.

The seal apparatus is operable in a plurality of modes, including a running mode of operation and a sealing mode of operation. In the running mode of operation, the sealing ring is maintained in a radially-reduced position, out of engagement with the wellbore surface. In the sealing mode of operation, the metal seal point of the sealing ring is in sealing metal-to-metal engagement with the wellbore surface, providing a fluid-tight seal at a selected location between the conveyance tubular and the wellbore tubular. The seal apparatus of the present invention further includes an actuator member, which is selectively and remotely actuatable, for urging the sealing ring between the running and sealing modes of operation.

In the preferred embodiment of the present invention, the inner surface of the wellbore tubular comprises the wellbore surface against which the seal operates, and the first surface of the sealing ring comprises an inner surface which is proximate an outer surface of the conveyance tubular, the second surface of the sealing ring comprises an outer surface which sealingly engages the inner surface of the wellbore tubular during the sealing mode of operation.

Also, in the preferred embodiment, the inner surface of the sealing ring at least in-part defines a clearance which is between the sealing ring and the conveyance tubular. The actuator member includes a wedge component which is driven into this cavity to selectively radially expand the sealing ring between the radially-reduced running mode of operation and the radially-expanded sealing mode of operation. Preferably, the sealing ring is radially expanded in shape by deformation through the wedging action of the actuator member.

In the preferred embodiment, the metal seal point of the sealing ring comprises at least one circumferential seal bead which is generally triangular in cross-section, and which is urged to engage the wellbore surface during the sealing mode of operation. Also, preferably, the seal apparatus further includes a layer of resilient material disposed over at least a portion of the sealing surface of the sealing ring. The layer of resilient material has as inner surface which is in engagement with the sealing surface of the sealing ring. Selected ones of the plurality of portions of the sealing ring extend radially outward and into the layer of resilient material, and are in gripping engagement therewith. These radially-extended portions prevent the layer of resilient material from swabbing-off during the running mode of operation. In the preferred embodiment, the layer of resilient material includes an exterior surface of substantially uniform radial dimension, which sealingly engages the wellbore surface during the sealing mode of operation, in supplementation of the sealing engagement between the metal seal point and the wellbore surface. In the preferred embodiment, the layer of resilient material further operates to prevent entrapment of wellbore fluids between selected ones of the metal seal points during the sealing mode of operation, while the seal points serve also to prevent extrusion of the layer of resilient material.

Preferably, the portions of the sealing surface of the sealing ring which defines the extender members extend into the layer of resilient material, and provide a skeletal structure (that is, a structural framework) for the layer of resilient material, to prevent swabbing-off of the layer of resilient material during the running mode of operation. The plurality of extender members are oriented at selected angles relative to the sealing ring to counteract directional forces acting on the layer of resilient material during the running mode of operation. Preferably, the plurality of extender members include at least one extender member oriented generally outward and downward from the sealing surface of the sealing ring to counteract upward axial forces acting on the layer of resilient material during the running mode of operation, and at least one extender member oriented generally outward and upward from the sealing surface of the sealing ring to counteract downward axial forces acting on the layer of resilient material during the running mode of operation.

As stated above, in the preferred embodiment of the present invention, the inner surface of sealing ring at least in-part defines a cavity between the sealing ring and the conveyance tubular, which is generally triangular in cross-section. The actuator member terminates at a wedge portion which is also generally triangular in cross-section, and which extends a selected distance into the cavity during the running mode of operation, but which is urged deeper in the cavity during the sealing mode of operation. The sealing ring is formed of a selected material which yields to expand a selected distance relative to the conveyance tubular in response to insertion of the wedge portion into the cavity. In the preferred embodiment, the actuator member includes an actuator sleeve which circumferentially engages the conveyance tubular, with the wedge ring coupled to the lowermost end of the actuator sleeve, and means for applying selected axial force to the actuator sleeve. A locking mechanism is also provided in the preferred embodiment which allows only downward movement of the actuator sleeve relative to the conveyance tubular to prevent the metal-to-metal seal of the present invention from accidentally disengaging from the sealing mode of operation.

Additional objects, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objects and advantages thereof, will best be understood by reference to the following detailed description of an illustrative embodiment when read in conjunction with the accompanying drawings, wherein:

DETAILED DESCRIPTION OF THE INVENTION

Figure 1:
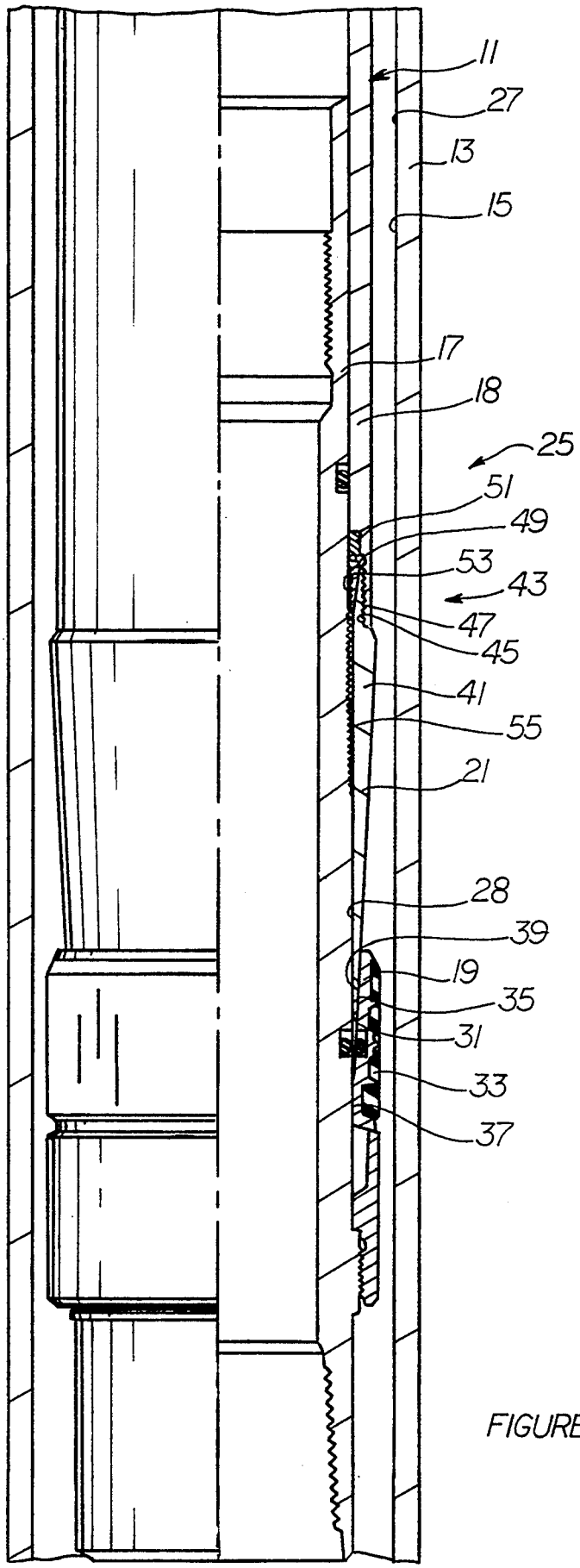
FIG. 1 is a one-quarter longitudinal section view of the preferred embodiment of the seal apparatus of the present invention in a running mode of operation, disposed concentrically within a wellbore tubular.

FIG. 1 is a one-quarter longitudinal section view of the preferred embodiment of the seal apparatus 11 of the present invention in a running mode of operation, and disposed concentrically within wellbore tubular 13. Conveyance tubular 17 is preferably coupled to force transmitting sleeve 18 which is part of a tubular workstring (not depicted) which is used to lower conveyance tubular 17 to a selected location within wellbore 25 relative to tubular members 13. As is shown in FIG. 1, seal apparatus 11 is adapted in radial dimension for passage through central bore 27 of tubular member 13. Seal apparatus 11 is depicted in FIG. 1 in a radially-reduced running mode of operation, during which seal apparatus 11 is out of contact with wellbore surface 15 which defines central bore 27 of tubular member 13. In contrast, in FIG. 2, seal apparatus 11 is shown in a radially-enlarged sealing mode of operation, in which components of seal apparatus 11 are in gas-tight sealing engagement with wellbore surface 15 of tubular member 13.

Returning now to FIG. 1, seal apparatus 11 of the preferred embodiment of the present invention includes sealing ring 19 which is circumferentially disposed about at least a portion of external surface 29 of conveyance tubular 17. As is shown in FIG. 1, sealing ring 19 includes interior surface 31 and exterior surface 33, with interior surface 31 including upper portion 35 and lower portion 37, with upper portion 35 at least in-part defining an annular cavity 39 which extends circumferentially about external surface 29 of conveyance tubular 17 and sealing ring 19, and which is generally triangular in cross-section. Interior surface 31 of sealing ring 19 further includes lower portion 37 which circumferentially engages external surface 29 of conveyance tubular 17.

As shown in FIG. 1, actuator member 21 extends downward into annular cavity 39, and completely fills it. Actuator member 21 includes conical wedge ring 41, force-transferring sleeve 18, and actuator linkage 43. In the preferred embodiment, wedge ring 43 and force-transferring sleeve 18 are coupled by external threads 45 on the uppermost end of wedge ring 41 and by internal threads 47 at the lowermost end of force-transferring sleeve 18. Actuator linkage 43 further includes ratchet ring 49 and retainer ring 51. Ratchet ring 49 is annular in shape, and includes an interior surface upon which are disposed inwardly-facing ratchet teeth 53, which are machined in the "down" position. These inwardly-facing ratchet teeth 53 are adapted for engaging outwardly-facing ratchet teeth 55 which are circumferentially disposed along a portion of external surface 29 of conveyance tubular 17, and which are machined in the "up" position. Ratchet teeth 55, 57 are adapted to allow only downward movement of ratchet ring 51, and to oppose upward movement of ratchet ring 49 relative to conveyance tubular 17.

Figure 2:
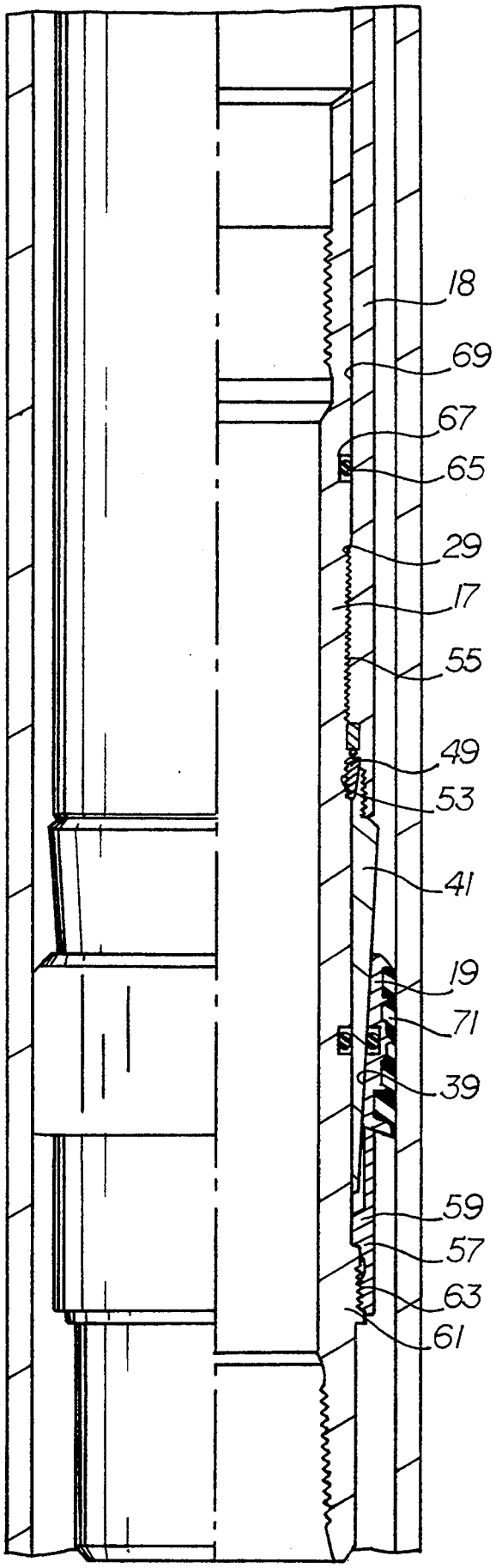
FIG. 2 is a one-quarter longitudinal section view of the preferred embodiment of the seal apparatus of the present invention in a sealing mode of operation, in sealing engagement with an interior surface of a wellbore tubular.

FIG. 2 is a one-quarter longitudinal section view of the preferred embodiment of the seal apparatus 11 of the present invention in a sealing mode of operation, in sealing engagement with wellbore surface 15 of tubular member 13. As shown therein, downward movement of force-transferring sleeve 18 will cause wedge ring 41 to be urged downward into annular cavity 39 which applies a radial force to sealing ring 19 causing the material which forms sealing ring 19 to deform by expanding radially outward and into contact with wellbore surface 15 of tubular member 13. Downward movement of force-transferring sleeve 18 also causes ratche ring 49 to travel downward along external surface 29 of conveyance tubular 17. As stated above, the orientation of ratchet teeth 53, 55 ensure that movement of ratchet ring 49 is limited to one direction, namely downward relative to conveyance tubular 17.

Sealing ring 19 is prevented from moving downward in response to downward displacement of force-transferring sleeve 18 by operation of buttress member 57 which is secured in a fixed position relative to conveyance tubular 17 by threaded coupling 63 and the mating of internal shoulder 59 of buttress member 57 and external shoulder 61 of conveyance tubular 17.

The potential leakage pathway at the interface of force-transferring sleeve 18 and conveyance tubular 17 is sealed by operation of O-ring seal 65 which is disposed in O-ring cavity 67 at external surface 29 of conveyance tubular 17, which operates to provide a dynamic, gas-tight seal with interior surface 69 of force-transferring sleeve 18.

As shown in FIG. 2, sealing ring 19 includes a layer of resilient material 71, which is in the preferred embodiment an elastomeric layer which is formed upon, or bonded, by conventional means, to exterior surface 33 of sealing ring 19.

Figure 3B:
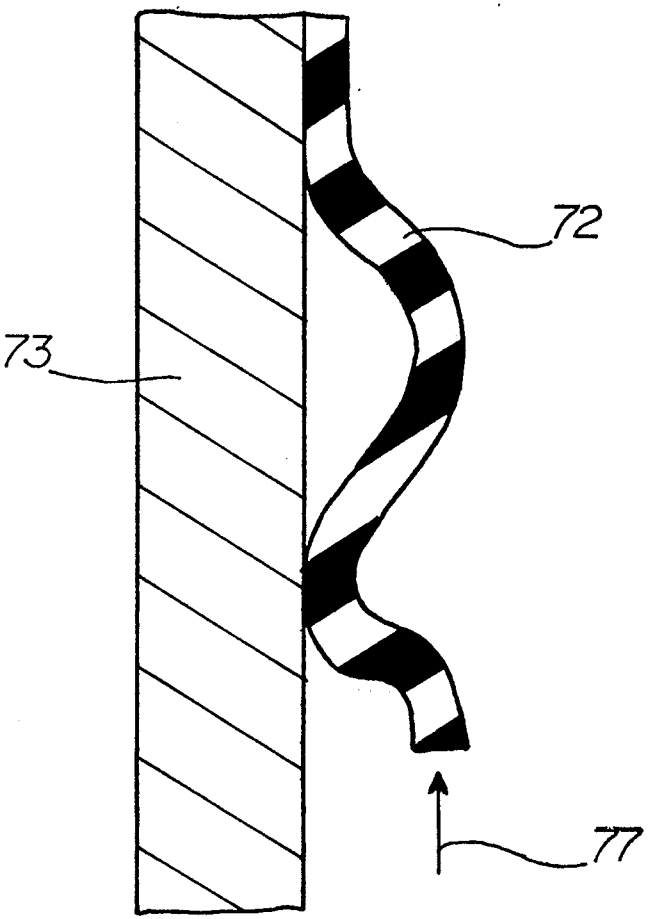
PRIOR ART FIGURE 3b
FIG. 3*b* is a partial longitudinal section view of a prior art mandrel with an elastomeric outer layer swabbing-off the mandrel in response to axial forces applied thereto.
Figure 3A:
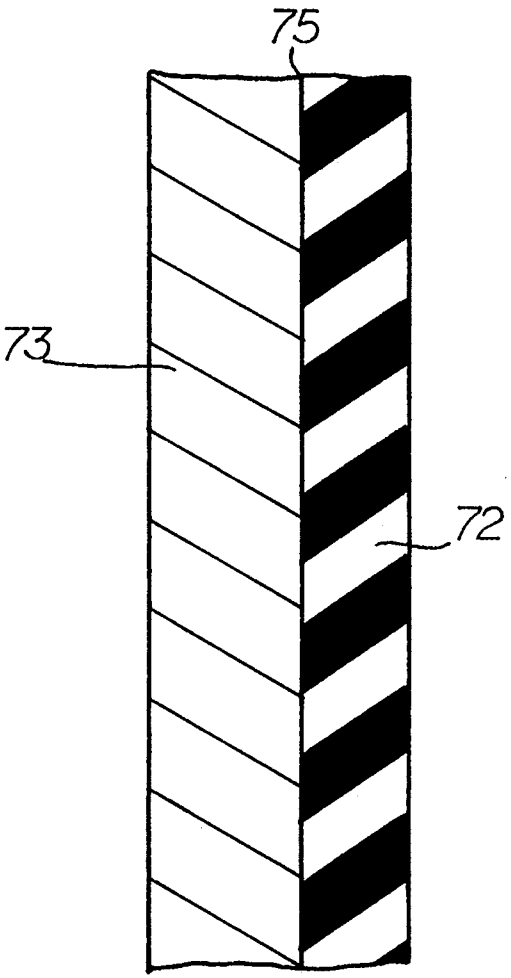
PRIOR ART FIGURE 3a
FIG. 3*a* is a partial longitudinal section view of a prior art mandrel with an elastomeric outer layer disposed thereon.

FIGS. 3*a* and 3*b* are partial longitudinal section views of a prior art mandrel with an elastomeric outer layer disposed thereon, with FIG. 3*b* depicting the swabbing-off of the elastomeric layer from the mandrel in response to axial forces applied thereto. FIG. 3*a* is a simplified depiction of a design which is common in wellbore completion equipment, in which elastomer band 72 is bonded to an exterior surface of mandrel 73 by use of adhesive 75 (which is not visible in either FIGS. 3*a* or 3*b*). During running modes of operation, mandrel 73 will be lowered into a wellbore having fluids disposed therein. Fluid flow within the well in combination with the pressure differential created by the occlusion of a portion of the wellbore by mandrel 73 will create axial force 77 which may detach elastomer band 72 from mandrel 73, resulting in "swabbing-off" of elastomer band 72. Of course, the loss or displacement of elastomer band 72 could seriously impair the operation of a wellbore tool, which, for example, may be depending upon elastomer band 72 to supply a sealing engagement with other wellbore components.

Seal apparatus 11 of the present invention is designed to avoid the swabbing-off of a layer of resilient material 71, but also functions to provide a seal which combines many of the attractive features of metal-to-metal seals and elastomeric seals, as will be described now with reference to FIGS. 4 and 5.

Figure 4:
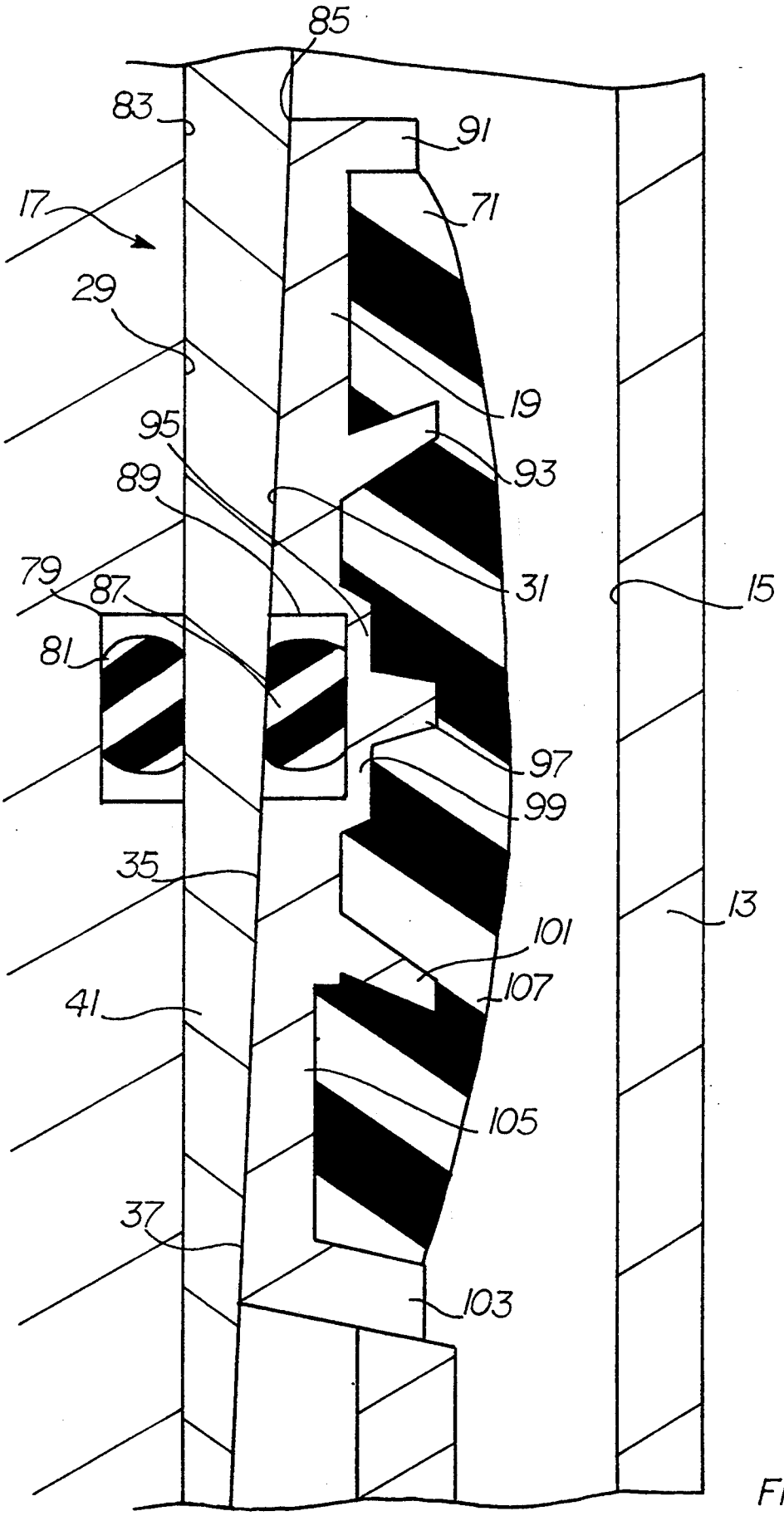
FIG. 4 is a partial longitudinal section view of the preferred seal apparatus of the present invention in a position intermediate that of the running and sealing modes of operation.

FIG. 4 is a partial longitudinal section view of the preferred seal apparatus 11 of the present invention in a position intermediate that of the running and sealing modes of operations which are depicted in FIGS. 1 and 2. FIG. 5 is a partial longitudinal section view of the preferred embodiment of seal apparatus 11 of the present invention in a sealing mode of operation, in gas-tight and fluid-tight sealing engagement with wellbore surface 15 of tubular member 13. As shown, wedge ring 41 includes inner surface 83 which slidably engages external surface 29 of conveyance tubular 17. The potential leak path at the interface of inner surface 83 and external surface 29 is sealed against leakage by operation of O-ring seal 81 which is disposed in O-ring cavity 79, which is formed in conveyance tubular 17 at external surface 29.

Wedge ring 41 further includes outer surface 85 which slidably engages interior surface 31 of sealing ring 19. The potential leak path at the interface of interior surface 31 and outer surface 85 is sealed against fluid leakage by operation of O-ring seal 87 which is disposed in O-ring cavity 89 which is formed in sealing ring 19 at interior surface 31. O-ring seal 87 provides a gas-tight and fluid-tight dynamic seal at the sliding interface of the surfaces.

As is shown in FIG. 4, inner surface 83 of wedge ring 41 is parallel with the central longitudinal axis of conveyance tubular 17. In contrast, outer surface 85 of wedge ring 41 is disposed at an angle from the central longitudinal axis of conveyance tubular 17. As shown, the taper in wedge ring 41 which is defined by the inclination of outer surface 85 ensures that upper portions of wedge ring 41 will be thicker in radial dimension than the lower portions of wedge ring 41. In the preferred embodiment of the present invention, wedge ring 41 includes outer surface 85 which is disposed at three degrees of inclination from the longitudinal central axis of conveyance tubular 17.

As is shown in FIG. 4, sealing ring 19 includes raised portions 91, 93, 95, 97, 99, 101, and 103 which extend radially outward from the body portion 105 of sealing ring 19 a plurality of differing radial dimensions, and which define a plurality of extender members which extend from body portion 105, and which serve a variety of functions including: engaging in a metal-to-metal sealing engagement with wellbore surface 15, to provide back-up resilient seals which supplement the sealing action of the metal-to-metal seals, preventing the entrapment of corrosive or other wellbore fluids between selected metal seal points, and to provide a skeletal framework for a layer of resilient material 71 which extends over most of the exterior "sealing" surface 33 of sealing ring 19 and which prevents "swabbing-off" of the layer of resilient material 71 due to axial forces applied to the layer of resilient material 71 during the running mode of operation. As shown in FIG. 4, layer of resilient material 71 defines a substantially uniform sealing surface 107, which is generally cylindrical in shape, which completely covers raised portions 91, 93, 95, 97, 99, 101, and 103.

The functions of raised portions 91, 95, 97, 99, 101, 103, and the layer of resilient material 71 can best be explained with reference to FIGS. 5 and 6 which depict, in partial longitudinal section view, two embodiments of the seal apparatus 11 of the present invention in sealing modes of operation. The embodiment shown in FIG. 5 is the preferred embodiment of the present invention, while the embodiment shown in FIG. 6 is an alternative embodiment of the present invention. The differences between these embodiments is easily explained with reference to FIGS. 5 and 6. As shown in FIG. 5, metal seal points 109, 111, and 113 are composed of a material which is softer than the material which forms wellbore surface 15 of tubular member 13; therefore, the outermost extents (that is "tips") of metal seal points 109, 111, and 113 are blunted or slightly deformed after coming into engagement with wellbore surface 15 of tubular member 13. While blunted, they still provide a zero extrusion gap and a gas-tight seal between sealing ring 19 and wellbore surface 15 of tubular member 13. In contrast, in the embodiment of FIG. 6, metal seal points 115, 117, and 119 are composed of a material which is harder than that which forms wellbore surface 15 of tubular member 13; therefore, metal seal points 115, 117, and 119 will in fact penetrate the material which forms wellbore surface 15 of tubular member 13, also providing a zero extrusion gap for a gas-tight seal.

Figure 5:
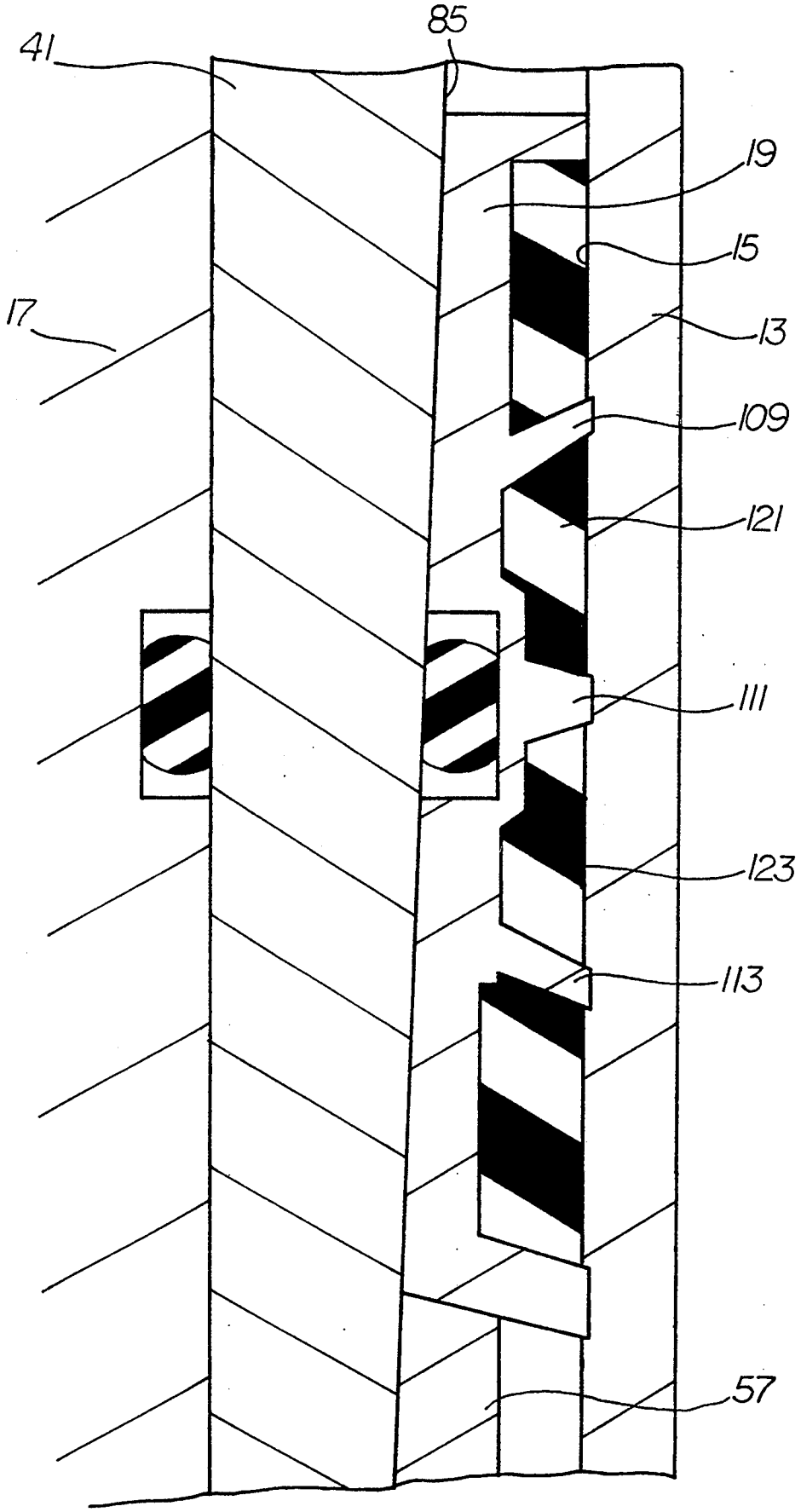
FIG. 5 is a partial longitudinal section view of the preferred embodiment of the seal apparatus of the present invention in a sealing mode of operation.
Figure 6:
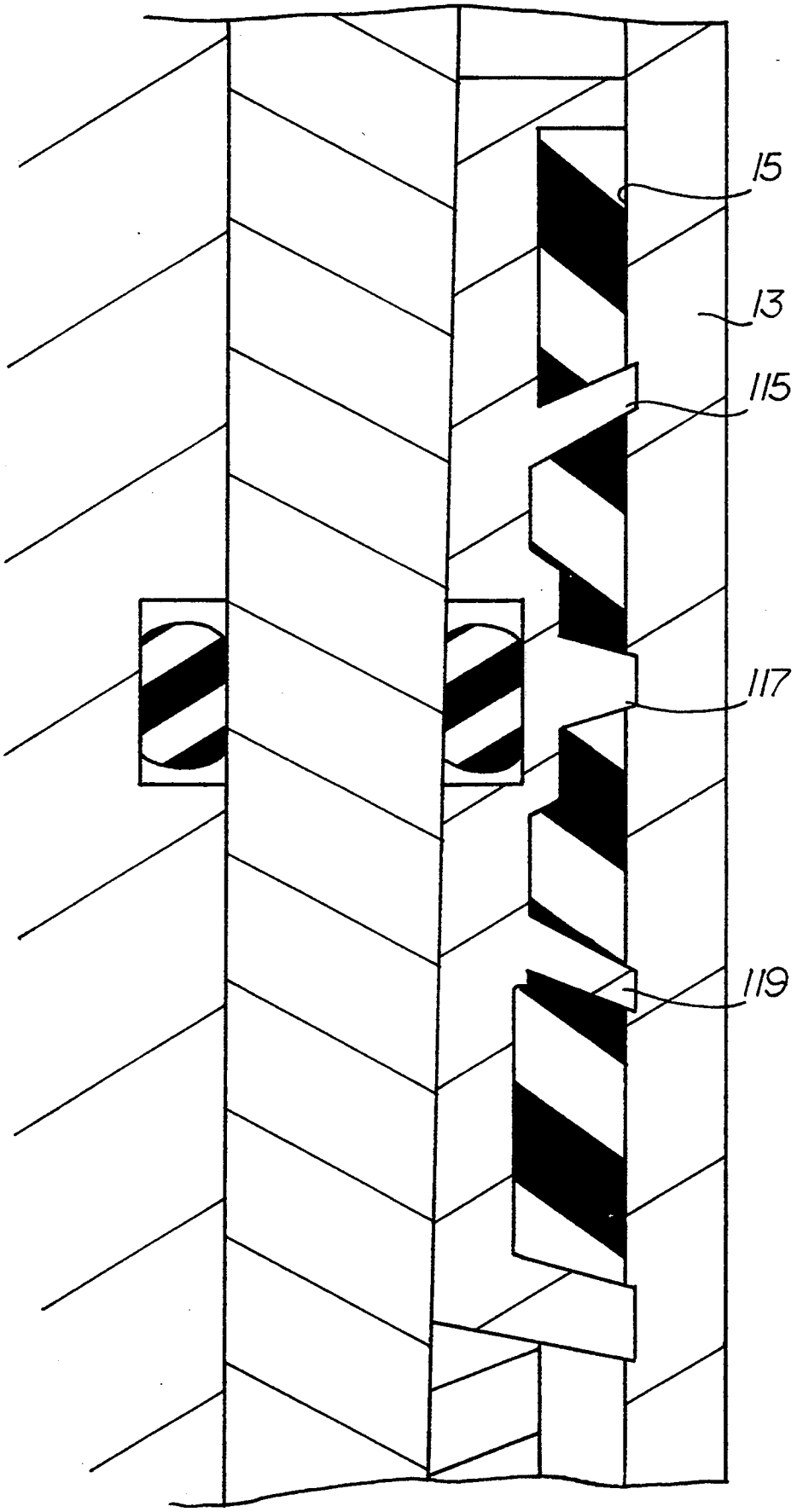
FIG. 6 is a partial longitudinal section view of an alternative embodiment of the seal apparatus of the present invention in a sealing mode of operation.

In the preferred embodiment of FIG. 5, metal seal points 109, 111, 113 are formed of 1020 steel, which has a known, industry-standard modulus of elasticity and Poisson ratio; while tubular member 13 comprises a polished seal bore which is formed of 4140 steel. In the alternative embodiment of FIG. 6, metal seal points 115, 117, and 119 should be formed of a harder steel. Of course, the seal apparatus 11 of the present invention may also function to provide a metal-to-metal sealing engagement with conventional wellbore tubulars, such as tubing and casing strings.

Returning once again to FIG. 5, the cooperation of the metal and resilient sealing components will be described in detail. This description is equally applicable to the embodiment of FIG. 6. The principal functions of sealing ring 19, with layer of resilient material 71 disposed thereon, include providing a high quality, gas-tight metal-to-metal seal between sealing ring 19 and wellbore surface 15 of tubular member 13, providing a back-up resilient seal between the layer of resilient material 71 and wellbore surface 15 of tubular member 13, preventing the extrusion of portions of the layer of resilient material 71 from between selected metal seal points, and preventing the accumulation or entrapment of corrosive or other wellbore fluids around or between selected metal seal points.

As is shown in FIG. 5, as wedge ring 41 is wedged downward into annular cavity 39, thicker portions of wedge ring 41 are urged between conveyance tubular 17 and sealing ring 19 (which are both stationary). Sealing ring 19 is maintained in a fixed position relative to both conveyance tubular 17 and tubular member 13 by operation of buttress member 57. Wedge ring 41 will apply a force to sealing ring 19 which includes both axial and radial force components. Force is provided to wedge ring 41 by conventional means, such as applying set down weight from a drilling or work-over rig to a workstring which includes force-translating sleeve 18. The axial force component provided by wedge ring 41 serves to overcome the frictional resistance to the insertion of wedge ring 41 into annular cavity 39. The radial force component (which is a sine function of the axial force component, and which depends upon the angle of inclination of outer surface 85 of wedge ring 41) serves to work against the material which comprises sealing ring 19, causing deformation of sealing ring 19 by outwardly radially expanding sealing ring 19 between the radially-reduced position of the running mode of operation and the radially-expanded position of the sealing mode of operation.

In the preferred embodiment of the present invention, conveyance tubular 17 is formed of 4140 steel, having known and industry standard modulus of elasticity and Poisson ratio, in to the form of a cylinder having an outer diameter of 7 inches and an inner diameter of 6.25 inches. In the preferred embodiment, sealing ring 19 is also formed of 1020 steel. (The dimensions of the preferred sealing ring 19 of the present invention will be described in greater detail herebelow with reference to FIG. 8.) Conveyance tubular 17 will not collapse or yield in response to radial force applied to sealing ring 19 by operation of wedge ring 41; instead, conveyance tubular 17 will provide a firm buttress to wedge ring 41.

Accordingly, sealing ring 19 will expand radially outward in response to the radial component of the axial force applied thereto by operation of wedge ring 41. The operational result is that metal seal points 109, 111, and 113 will be urged radially outward into engagement with wellbore surface 15 of tubular member 13. In the preferred embodiment, since metal seal points 109, 111, 113 are formed of a material comparable in hardness to wellbore surface 15, they will become blunted and deformed and may in-fact extend slightly into wellbore surface, yet will provide a gas-tight, extrusion resistant metal-to-metal seal with wellbore surface 15 of tubular member 13.

As sealing ring 19 and layer of resilient material 71 are urged radially outward, wellbore fluids, including corrosive fluids, which would otherwise have been trapped between metal seal points 109, 111, and 113, are expelled by displacement either upward or downward relative to sealing ring 19.

The layer of resilient material 71, which in the preferred embodiment comprises an elastomeric band, will itself come into sealing engagement with wellbore surface 15 of tubular member 13, providing a back up seal to the seals provided by metal seal points 109, 111, and 113. The sealing action of the layer of resilient material 71 can be quite good, provided wellbore temperatures in the vicinity of seal apparatus 11 are below 450 degrees Fahrenheit. Temperatures above 450 degrees Fahrenheit will quickly impair the sealing function of the layer of resilient material 71, which is preferably formed of an elastomeric material. However, thermoplastic or other materials can be used to form the layer of resilient material 71, which have still higher operating temperature ranges, and which are thus useful in wellbore regions which have temperatures which exceed 450 degrees Fahrenheit.

Irrespective of the range of temperatures encountered in the wellbore, the sealing engagement between metal seal points 109, 111, and 113 also serve to provide an extrusion barrier to portions 121, 123 of the layer of resilient material 71 which is trapped between seal points 109, 111, 113 respectively. Thus, when wellbore temperatures are high, portions 121, 123 serve primarily as a mechanism for evacuating wellbore fluids from between seal points 109, 111, 113; however, when temperatures encountered in the wellbore are within the range of operating temperatures associated with the material which comprises the layer of resilient material 71, portions 121, 123 serve as back-up elastomeric-type resilient seals, and cooperate with the metal-to-metal seals of metal seal points 109, 111, 113 and wellbore surface 15 of tubular member 13. As shown in FIG. 5, at a low temperature range, seal apparatus 11 of the present invention provides three metal-to-metal seals and two resilient seals.

As explained above with regard to FIGS. 3*a* and 3*b*, during running modes of operation, wellbore fluids create axial forces which act upon the layer of resilient material 71, and which tend to cause the material to swab-off. The design and orientation of raised portions 91, 93, 95, 97, 99, 101, and 103 (of FIG. 4) define a structural framework upon which the layer of resilient material 71 is formed or bonded, which deters and resists the axial forces which would otherwise urge the layer of resilient material 71 to swab-off sealing ring 19.

For example, with reference now to FIG. 4, raised portions 91, 103 provide a leading edge for sealing ring 19 which respectively shield the layer of resilient material 71 from axial forces encountered during downward and upward displacement within the wellbore. Raised portion 93 defines an extender member which is oriented generally outward and upward from the sealing surface 33 of sealing ring 19, which extends into the layer of resilient material 71, and counteracts or resists downward axial forces acting on the layer of resilient material 71 during the running mode of operation. Conversely, raised portion 101 defines an extender member which is oriented generally outward and downward from sealing surface 33 of sealing ring 19, which extends into the layer of resilient material 71, and which resists or counteracts upward axial forces acting on the layer of resilient material 71.

Likewise, the raised shoulder defined by raised portion 95 extends into the layer of resilient material 71, and is oriented generally outward and upward from the sealing surface 33 of sealing ring 19, to resist or counteract downward axial forces acting on the layer of resilient material 71. Conversely, the shoulder defined by raised portion 99 extends into the layer of resilient material 71 and is oriented generally outward and downward from sealing surface 33 of sealing ring 19, and serves to resist or counteract upward axial forces acting on the layer of resilient material 17 during the running mode of operation.

Raised portion 97 defines an extender member which is oriented directly radially outward, and which is thus equally resistive to both upward and downward axial forces, and cannot be considered a directional-specific extender member. In this manner, raised portions 91, 93, 95, 97, 99, 101, and 103 cooperate together to minimize the opportunity for swabbing-off of the layer of resilient material 71 from sealing surface 33 of sealing ring 19.

Figure 8:
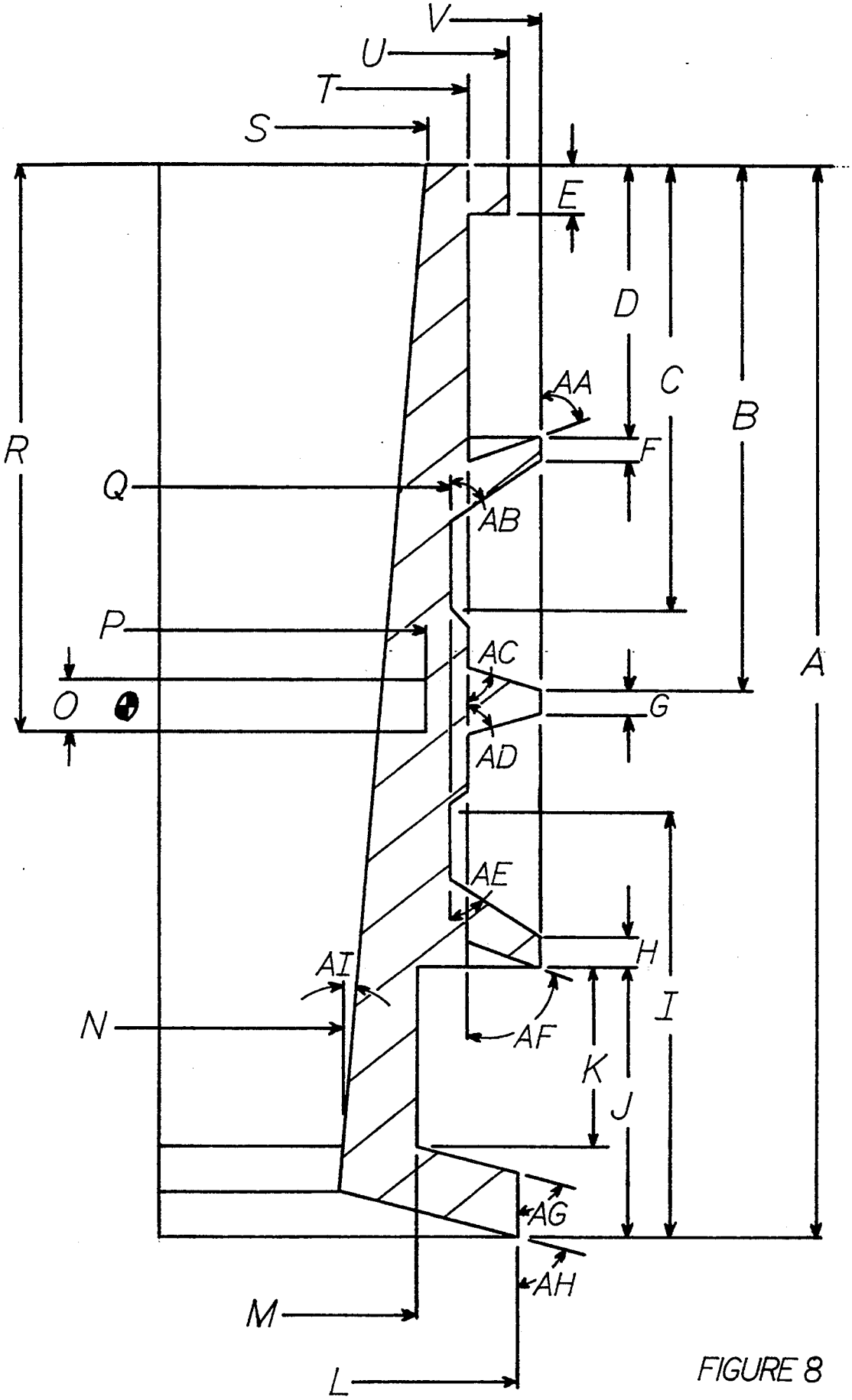
FIG. 8 is a simplified partial longitudinal section view of the preferred seal apparatus of the present invention depicting the geometric configuration of the sealing surface of the sealing ring, which should be read with reference to Tables 1 and 2 which provide actual dimensions of the preferred embodiment.

FIG. 8 is a cross-section view of sealing ring 19 of the preferred embodiment of the present invention, and is used to provide a precise physical description of the various components which together comprise sealing ring 19. Physical dimensions, including distances and angles are indicated on the figure by single letters for length and width dimensions, and double letters for angles. Please note that lateral dimension lines on FIG. 8 indicate diameter of the portion, unless specifically indicated otherwise. For example, the letter "L" indicates the outer diameter from the outermost radial surface of raised portion 103 of sealing ring 19. Other measurements, such as "I" indicate the distance between the dimension lines which are provided as an overlay on the cross-section view of sealing ring 19. Length and width dimensions are provided in Table 1, and angle measurements are provided in Table 2.

Figure 7:
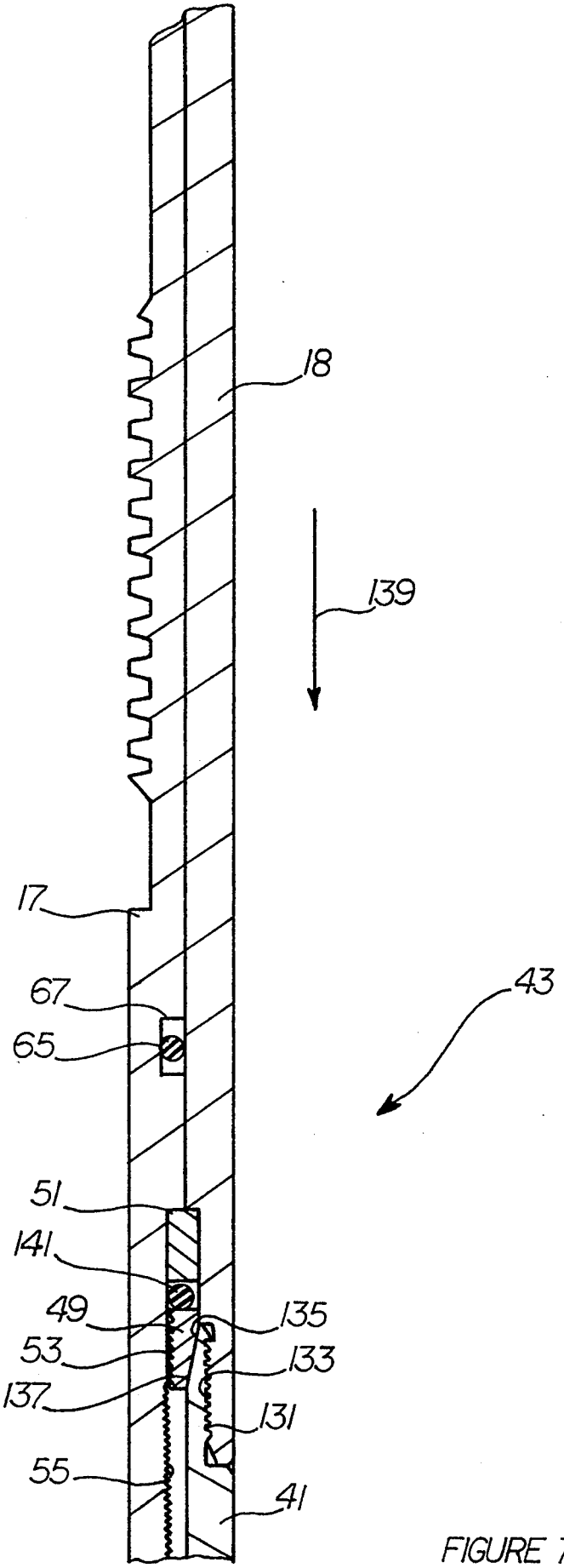
FIG. 7 is a fragmentary longitudinal section view of the seal apparatus of the present invention, depicting the actuator linkage which allows a transfer of axial force in only one direction which serves to lock the seal apparatus in the sealing mode of operation in sealing engagement with the wellbore surface.

FIG. 7 is a fragmentary longitudinal section view of a portion of seal apparatus 11 of the present invention, depicting actuator linkage 43 which allows a transfer of axial force in only one direction to urge the seal apparatus 11 into sealing engagement with wellbore surface 15. Actuator linkage 43 was discussed above generally in connection with FIG. 2. As shown in FIG. 7, external threads 131 of the upper portion of wedge ring 41 engage internal threads 133 of the lowermost portion of force-transferring sleeve 18. Wedge ring 41 includes interior inclined surface 135 which engages exterior inclined surface of ratchet ring 49. Ratchet ring 49 includes inwardly-facing ratchet teeth 53 which engage outwardly facing ratchet teeth 55 of conveyance tubular 17, as axial force 139 is applied to force-transferring sleeve 18. Retaining ring 51 comprises, in the preferred embodiment, a snap ring. O-ring 141 is disposed between retainer ring 51 and ratchet ring 49 and functions as a rubber spring to hold the retainer ring in place.

Actuator linkage 43 of the present invention operates to lock wedge ring 41 in a fixed position relative to sealing ring 19 once the sealing mode of operation of obtained. This ensures that the metal-to-metal seal obtained by seal apparatus 11 of the present invention is permanently energized and maintained in the sealing mode of operation to prevent accidental, or unintentional, release of the sealing engagement between sealing ring 19 and wellbore surface 15 of tubular member 13.

The present invention may also be characterized as a method of sealing in a wellbore having a tubular member disposed therein which defines a wellbore surface. The method includes steps of providing a metal conveyance tubular with a cylindrical outer surface, and providing a metal sealing ring with at least one circular metal extender portion extending radially outward from the outer surface of the metal sealing ring. The metal sealing ring should also be provided with a contoured inner surface. The metal sealing ring is placed around the metal conveyance tubular so that the contoured inner surface at least in-part defines an annular cavity around the metal conveyance tubular. A metal conical wedge ring is provided which has a sloped outer surface. The metal conical wedge ring is placed around the metal conveyance tubular and disposed at least in-part within the annular cavity between the metal conveyance tubular and the metal sealing ring.

The metal conveyance tubular, metal sealing ring, and metal conical wedge ring are lowered into the wellbore to a desired location within the central bore of the tubular member. Then, an axial load is applied to the metal conical wedge ring to drive it between the metal conveyance tubular and the metal sealing ring, causing the metal sealing ring to deform by expanding radially outward. At least one circular metal extender portion which is disposed on the outermost surface of the metal seal ring is urged into sealing metal-to-metal engagement with the wellbore surface of the tubular member.

In this manner, the annular region which is defined between the conveyance tubular and the tubular member is occluded by a gas-tight barrier which is composed substantially entirely of metal components. Since the sealing barrier is composed of metal, preferably steel, the metal-to-metal seal apparatus of the present invention can provide a seal which can withstand extremely high pressure differentials, as opposed to conventional seals which form an annular barrier which at least in-part includes substantial elastomeric components.

Laboratory tests have revealed that the metal-to-metal seal apparatus of the present invention can withstand pressure differentials of between 10,000 and 16,000 pounds per square inch, at extremely high temperatures. It is believed that the metal-to-metal seal of the present invention can provide a gas-tight barrier to pressure differentials of 20,000 pounds per square inch or greater. It can thus be appreciated that the seal apparatus and method of the present invention can provide a high quality, gas-tight sealing engagement, which may find many commercial uses in wellbore drilling and completion operations.

While the invention has been shown in only one of its forms, it is not thus limited but is susceptible to various changes and modifications without departing from the spirit thereof.

TABLE 1

| | |
|---|---|
| A | 3.5 inches |
| B | 1.75 inches |
| C | 1.50 inches |
| D | 1.00 inches |
| E | 0.10 inches |
| F | 0.015 inches |
| G | 0.015 inches |
| H | 0.015 inches |
| I | 1.50 inches |
| J | 1.00 inches |
| K | 0.75 inches |
| L | 8.125 inches |
| M | 7.75 inches |
| N | 7.45 inches |
| O | 0.18 inches |
| P | 7.803 inches |
| Q | 7.90 inches |
| R | 1.84 inches |
| S | 7.780 inches |
| T | 8.00 inches |
| U | 8.125 inches |
| V | 8.210 inches |

TABLE 2

| | |
|---|---|
| AA | 75 degrees |
| AB | 60 degrees |
| AC | 60 degrees |
| AD | 60 degrees |
| AE | 60 degrees |
| AF | 75 degrees |
| AG | 75 degrees |
| AH | 75 degrees |
| AI | 3 degrees |

What is claimed is:

1. A seal apparatus for use in a subterranean wellbore having a wellbore tubular disposed therein, said wellbore tubular defining a wellbore surface, comprising:

a conveyance tubular positionable within said subterranean wellbore at a selected location relative to said wellbore surface;

a sealing ring, disposed about at least a portion of said conveyance tubular, said sealing ring having a first surface proximate said conveyance tubular and a second surface, said second surface being a sealing surface with a plurality of portions, with selected ones of said plurality of portions of said sealing ring extending radially from said conveyance tubular in at least one radial dimension and defining at least one metal seal point for selective sealing engagement with said wellbore surface;

wherein said seal apparatus is operable in a plurality of modes of operation, including:

running mode of operation wherein said sealing ring is maintained in a radially-reduced position, out of engagement with said wellbore surface;

a sealing mode of operation, wherein said at least one metal seal point of said sealing ring in sealing metal-to-metal engagement with said wellbore surface, providing a fluid-tight seal at a selected location between said conveyance tubular and said wellbore tubular;

a layer of resilient material disposed over at least a portion of said sealing surface of said sealing ring, said layer of resilient material having an inner surface in engagement with said plurality of portions of said sealing ring, with said selected ones of said plurality of portions of said sealing ring extending radially outward and into said layer of resilient material, and in gripping engagement therewith, to prevent said layer of resilient material from swabbing-off during said running mode of operation;

an actuator member, selectively and remotely actuable, for urging said sealing ring between said running and sealing modes of operation.

2. A seal apparatus according to claim 1:

wherein said wellbore surface comprises an inner surface of said well tubular;

wherein said first surface of said sealing ring comprises an inner surface which is proximate an outer surface of said conveyance tubular; and wherein said second surface of said sealing ring comprises an outer surface which sealingly engages said inner surface of said wellbore tubular during said sealing mode of operation.

3. A seal apparatus according to claim 1:

wherein said first surface of said sealing ring at least in-part defines a clearance which is between said sealing ring and said conveyance tubular; and wherein said actuator member includes a wedge component which is driven into said cavity to selectively radially expand said sealing ring between said radially-reduced running mode of operation and said radially-expanded sealing mode of operation.

4. A seal apparatus according to claim 1:

wherein said sealing ring is radially expanded in shape, by deformation wedging action of said actuator member, from said radially-reduced running mode of operation to said radially-expanded sealing mode of operation.

5. A seal apparatus according to claim 1:

wherein said actuator member drives said at least one metal seal point of said sealing ring into penetrating engagement with said wellbore surface of said wellbore tubular during said sealing mode of operation.

6. A seal apparatus according to claim 1:

wherein said at least one metal seal point of said sealing ring comprises at least one circumferential seal bead which is generally triangular in cross-section, which is urged to penetrate said wellbore surface during said sealing mode of operation by operation of said actuator member.

7. A seal apparatus according to claim 1:

wherein said layer of resilient material comprises an elastomeric band formed upon said sealing ring.

8. A seal apparatus according to claim 1:

wherein said layer of resilient materials includes an exterior surface of substantially uniform radial dimension, which sealingly engages said wellbore surface during said sealing mode of operation in supplementation of said at least one metal seal point of said sealing ring.

9. A seal apparatus according to claim 1:

wherein said sealing surface of said sealing ring includes a plurality of wherein said sealing surface of said sealing ring includes a plurality of portions which define a plurality of extender members which extend into said layer of resilient material, providing a skeletal structure for said layer of resilient material to prevent swabbing-off of said layer of resilient material during said running mode of operation.

10. A seal apparatus according to claim 9:

wherein said plurality of extender members are oriented at selective angles relative to said sealing ring to counteract directional forces acting on said layer of resilient material during said running mode of operation.

11. A seal apparatus according to claim 9:

wherein said plurality of extender members includes at least one extender member oriented generally outward and downward from said sealing surface of said sealing ring to counteract upward axial forces acting on said layer of resilient material during said running mode of operation, and at least one extender member oriented generally outward and upward from said sealing surface of said sealing ring to counteract downward axial forces acting on said layer of resilient material during said running mode of operation.

12. A seal apparatus according to claim 1:

wherein said first surface of said sealing ring at least in-part defines a cavity between said sealing ring and said conveyance tubular, which is generally triangular in cross-section;

wherein said actuator member terminates at a wedge portion which is generally triangular in cross-section, and which extends a selected distance into said cavity during said running mode of operation but which is urged deeper into said cavity during said sealing mode of operation;

wherein said sealing ring is formed of a selected material which yields to expand a selected distance relative to said conveyance tubular in response to insertion of said wedge portion into said cavity.

13. A seal apparatus according to claim 12:

wherein said actuator member includes an actuator sleeve which circumferentially engages said conveyance tubular, a wedge ring coupled to said actuator sleeve, and means for applying a selected axial force to said actuator sleeve.

14. A seal apparatus for use in a subterranean wellbore having a wellbore tubular disposed therein, said wellbore tubular defining a wellbore surface, comprising:

a conveyance tubular positionable within said subterranean wellbore at a selected location relative to said wellbore surface;

a sealing ring, disposed about at least a portion of said conveyance tubular, said sealing ring having a first surface proximate said conveyance tubular and a second surface, said second surface being a sealing surface with a plurality of portions, with selected ones of said plurality of portions of said sealing ring extending radially from said conveyance tubular in at least one radial dimension and defining a plurality of metal seal points for selective sealing engagement with said wellbore surface;

wherein said seal apparatus is operable in a plurality of modes of operation, including:

running mode of operation wherein said sealing ring is maintained in a radially-reduced position, out of engagement with said wellbore surface;

a sealing mode of operation, wherein said plurality of metal seal points of said sealing ring is in sealing metal-to-metal engagement with said wellbore surface, providing a fluid-tight seal at selected locations between said conveyance tubular and said wellbore tubular;

an actuator member, selectively and remotely actuable, for urging said sealing ring between said running and sealing modes of operation;

wherein said wellbore tubular is in contact with wellbore fluids; and a sealing layer means, including a layer of resilient material disposed about at least a portion of said second surface of said sealing ring defining an outer surface, which, during said running mode of operation, is disposed radially outward from said plurality of metal seal points of said sealing ring with a portion of said layer of resilient material disposed between selected ones of said plurality of metal seal points of said seal ring, for preventing entrapment of said wellbore fluids between selected ones of said plurality of metal seal points during sealing mode of operation by expelling by displacement said wellbore fluid which is intermediate said outer surface of said layer of resilient material and said wellbore surface prior to (a) penetration of said layer of resilient material by said plurality of metal seal points and (b) sealing engagement with said wellbore surface by said plurality of metal seal points.

15. A seal apparatus for use in a subterranean wellbore having a wellbore tubular disposed therein, said wellbore tubular defining a wellbore surface, comprising a conveyance tubular positionable within said subterranean wellbore at a selected location relative to said wellbore surface, a sealing ring, disposed about at least a portion of said conveyance tubular, said sealing ring having a first surface proximate said conveyance tubular and a second surface, said second surface being a sealing surface with a plurality of portions, with selected ones of said plurality of portions of said sealing ring extending radially from said conveyance tubular in at least one radial dimension and defining at least one metal seal point for selective sealing engagement with said wellbore surface;

wherein said seal apparatus is operable in a plurality of modes of operation, including:

running mode of operation wherein said sealing ring is maintained in a radially-reduced position, out of engagement with said wellbore surface;

a sealing mode of operation, wherein said at least one metal seal point of said sealing ring is in sealing metal-to-metal engagement with said wellbore surface, providing a fluid-tight seal at a selected location between said conveyance tubular and said wellbore tubular;

an actuator member, selectively and remotely actuable, for urging said sealing ring between said running and sealing modes of operation;

wherein said plurality of portions of said sealing ring extend radially from said conveyance tubular and define a plurality of metal seal points for engagement with said wellbore surface during said sealing mode of operation;

wherein a layer of resilient material is disposed over said sealing surface of said sealing ring and extends between said plurality of metal seal points and which defines an outer surface, which, during said running mode of operation, is disposed radially outward from said plurality of metal seal points of said sealing ring; and wherein, during said sealing mode of operation, (a) said wellbore fluid which is intermediate said outer surface of said layer of resilient material is expelled by displacement by said layer of resilient material prior to penetration of said layer of resilient material by said plurality of metal seal points, each providing a seal, and (b) said layer of resilient material is urged into sealing contact with said wellbore surface, and is prevented from extrusion by said metal seal points.

16. In a wellbore containing fluid therein and having a tubular member disposed therein which includes a central bore which defines a wellbore surface, the method of sealing comprising:

providing a metal conveyance tubular with a cylindrical outer surface;

providing a metal sealing ring with at least one circular metal extender portion extending radially outward from an outer surface of said metal sealing ring, and having a contoured inner surface;

surrounding said metal sealing ring with a layer of resilient material disposed over at least a portion of the outer surface of said sealing ring, said layer of resilient material having an inner surface in engagement with said at least one circular metal extender portion of said sealing ring, with said at least one circular metal extender portion of said sealing ring extending radially outward and into said layer of resilient material, and in gripping engagement therewith, to prevent said layer of resilient material from swabbing-off during said running operations;

placing said metal sealing ring around said metal conveyance tubular so that said contoured inner surface at least in-part defines an annular cavity around said metal conveyance tubular;

providing a metal conical wedge ring having a sloped outer surface;

placing said metal conical wedge ring around said meal conveyance tubular and disposing at least a portion of it in said annular cavity;

lowering said metal conveyance tubular, said metal sealing ring, and said metal conical wedge ring to a desired location within said wellbore tubular within said central bore of said tubular member;

applying an axial load to said metal conical wedge ring to drive said metal conical wedge ring between said metal conveyance tubular and said metal sealing ring and cause said metal sealing ring to deform by expanding radially outward to urge said at least one circular metal extender portion into sealing metal-to-metal engagement with said wellbore surface of said tubular member; and wherein an annular region defined between said conveyance tubular and said tubular member is occluded by a gas-tight barrier which is composed substantially entirely of metal components.

17. The method of sealing according to claim 16, wherein said at least one circular metal extender portion comprises a plurality of circular metal extender portions, further comprising:

evacuating said fluid from between said plurality of circular metal extender portions to prevent entrapment of said fluid between said metal sealing ring and said wellbore surface.

18. The method of sealing according to claim 17, further comprising:

containing at least a portion of said layer of resilient material between selected ones of said plurality of circular metal extender portions in a manner which prevents extrusion.

19. The method of sealing according to claim 17, further comprising:

counteracting, with said at least one circular metal extender portion, axial forces on said layer of resilient material to prevent detachment of said layer of resilient material from said outer surface of said metal sealing ring.

20. In a wellbore containing fluid therein and having a tubular member disposed therein which includes a central bore which defines a wellbore surface, a method of sealing comprising:

providing a metal conveyance tubular with a cylindrical outer surface;

providing a metal sealing ring with a plurality of circular metal extender portions extending radially outward from an outer surface of said metal sealing ring, and having a contoured inner surface;

placing said metal sealing ring around said metal conveyance tubular so that said contoured inner surface at least in-part defines an annular cavity around said metal conveyance tubular;

providing a metal conical wedge ring having a sloped outer surface;

placing said metal conical wedge ring around said meal conveyance tubular and disposing at least a portion of it in said annular cavity;

providing a layer of resilient material;

lowering said metal conveyance tubular, said metal sealing ring, and said metal conical wedge ring to a desired location within said wellbore tubular within said central bore of said tubular member;

applying an axial load to said metal conical wedge ring to drive said metal conical wedge ring between said metal conveyance tubular and said metal sealing ring and cause said metal sealing ring to deform by expanding radially outward to urge said plurality of circular metal extender portions into sealing metal-to-metal engagement with said wellbore surface of said tubular member;

wherein an annular region defined between said conveyance tubular and said tubular member is occluded by a gas-tight barrier which is composed substantially entirely of metal components;

securing said layer of resilient material to said outer surface of said metal sealing ring; and evacuating said fluid from between said plurality of circular metal extender portions to prevent entrapment of said fluid between said metal sealing ring and said wellbore surface.

21. The method of sealing according to claim 20, further comprising:

containing at least a portion of said layer of resilient material between selected ones of said plurality of circular metal extender portions in a manner which prevents extrusion.

22. The method od sealing according to claim 20, further comprising:

counteracting, with said at least one circular metal extender portion, axial forces on said layer of resilient material to prevent detachment of said layer of resilient material from said outer surface of said metal sealing ring.

* * * * *